US006430748B1

(12) United States Patent
Burkhart

(10) Patent No.: US 6,430,748 B1
(45) Date of Patent: Aug. 13, 2002

(54) CLOSE FITTING WOMAN'S UNDERGARMENT

(76) Inventor: Jeannine W. Burkhart, 6408 Westminster Rd., Knoxville, TN (US) 37919

( * ) Notice: Subject to any disclaimer, the term of this patent is extended or adjusted under 35 U.S.C. 154(b) by 0 days.

(21) Appl. No.: 09/731,510

(22) Filed: Dec. 7, 2000

Related U.S. Application Data

(60) Provisional application No. 60/211,791, filed on Jun. 16, 2000.

(51) Int. Cl.[7] ..... A41C 3/00; A41D 27/13

(52) U.S. Cl. ..... 2/78.1; 2/54; 2/73; 450/1

(58) Field of Search ..... 2/78.1, 115, 70, 2/113, 109, 105, 110, 106, 69, 73, 54–56, 78.3, 78.4, 114, 125; 450/1

(56) References Cited

U.S. PATENT DOCUMENTS

| | | | | | |
|---|---|---|---|---|---|
| 124,891 | A | * | 3/1872 | Emery et al. | 2/80 |
| 144,609 | A | * | 11/1873 | Flynt | 2/110 |
| 206,358 | A | * | 7/1878 | Robbins | 2/110 |
| 1,029,583 | A | * | 6/1912 | Bennett | 2/78.1 |
| 1,477,248 | A | * | 12/1923 | Guinzburg | 2/109 |
| 1,771,179 | A | | 7/1930 | Koncen | |
| 2,066,298 | A | | 1/1936 | Messing | |
| 2,685,691 | A | * | 8/1954 | Artz | 2/113 |
| 3,508,279 | A | | 4/1970 | Ayoua | |
| 5,042,089 | A | * | 8/1991 | Carmer | 2/55 |
| 5,269,720 | A | * | 12/1993 | Moretz et al. | 2/73 X |
| 6,183,339 | B1 | * | 2/2001 | Thompson | 450/1 |

* cited by examiner

*Primary Examiner*—Gloria M. Hale
(74) *Attorney, Agent, or Firm*—Katherine Lovingood

(57) ABSTRACT

An undergarment, either a camisole or full slip, that has excellent wicking properties, fits the body snugly and is cut in such a way as to be unnoticeable beneath sheer outer wear.

3 Claims, 1 Drawing Sheet

CLOSE FITTING WOMAN'S UNDERGARMENT

This application in based on a previously filed provisional application No. 60/211,791, dated Jun. 16, 2000.

BACKGROUND OF THE INVENTION

This invention relates to a close fitting woman's undergarment and specifically to a camisole or slip that is designed in such a manner that it can be layered comfortably under sheer attire without being easily detected.

DESCRIPTION OF THE INVENTION

BACKGROUND OF THE INVENTION

Camisoles and slips worn beneath clothing are not new, however these undergarments can be detected under todays sheer fabrics and many people would rather not have their undergarments noticed. This is of particular interest to career women who must be always well groomed.

A search of prior inventions registered at the United States Patent and Trademark Office revealed related inventions. U.S. Pat. No. 3,508,279, Garment and Sleeve Construction, discloses a close fitting garment that is designed in such a Way that an absorbent pad can be placed in a pouch beneath the arm to absorb perspiration. It has a cap sleeve that is of a raglan design. However, the design does not address the problem of how to make an undergarment unnoticeable beneath sheer outer garments.

U.S. Pat. No. 1,771,179, Slip, discloses a basic slip that hangs from the shoulders by straps. The design provides for a loose fitting fabrics that creates bulk beneath outer wear.

U.S. Pat. No. 2,066,298, Lady's Garment, claims a four piece slip cut on the bias to allow stretching across the wearer's body.

Therefore there is a need for an undergarment that is designed in such a way that the neckline, arm lines and lower edge cannot be seen or detected under sheer outer wear.

There is also a need to have undergarments that fit closely to the body and wick moisture away.

Another object of the invention is to provide an undergarment that is suitable to wear under woman's professional clothing.

The final object of this invention is to provide a full slip meeting all the needs described above but further provides a nonclinging portion beneath the skirt area to allow a free drape of the skirt of the outer garment

BRIEF SUMMARY OF THE INVENTION

To satisfy these and other needs, the invention is an undergarment made of fabric capable of wicking moisture from a wearer's body without transferring the moisture to an outer garment. The fabric is cut and joined in such a way that the bulk and the edges of said fabric are not easily detected under sheer outerwear.

The fabric can be selected from among many that are currently available such as thin cotton yarn which is knit into a stretch knit fabric that is light weight, absorbent and exhibits superior stretching properties. The fabric is cut and sewn together using a stretch seam stitch that fits snugly but allows free range of motion of the arms and torso.

In the full slip embodiment, the skirt portion of the invention could be made of fabric that has superior slipping properties such as nylon knit.

DETAILED DESCRIPTION OF THE INVENTION

Figure 1:
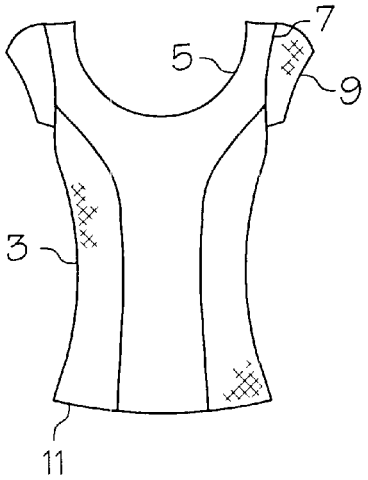
FIG. 1 is a depiction of the garment from either the front or the back, the essential elements of each being the same.
Figure 2:
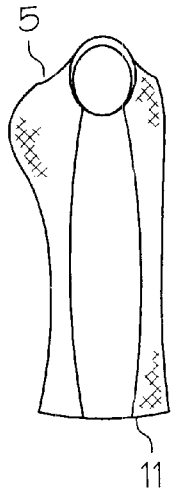
FIG. 2 is a depiction of the garment from the left side of the garment, the right side being a mirror image of the left.
Figure 3:
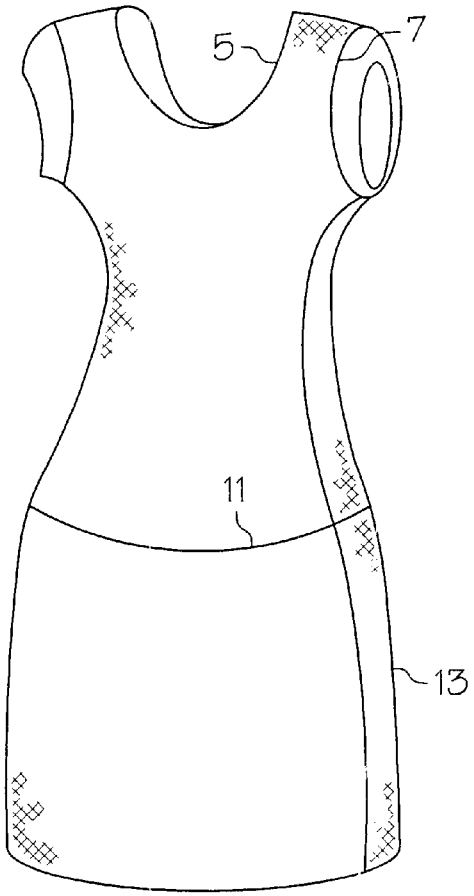
FIG. 3 depicts the full slip embodiment of the invention.
Figure 4:
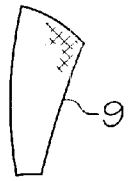
FIG. 4 shows the design of the sleeve of the garment.

It is important that career women be neatly dressed without drawing attention to themselves. One problem women have is underclothing that shows through outer clothing because fabrics are bulky or straps and bands bind tightly showing indentations in the body profile. Another problem is moisture being trapped beneath the under garment making the wearer uncomfortably warm.

Camisoles and slips have been available for years and they are intended to create a uncluttered profile beneath clothing. However, camisoles that fit snugly often have apparent edges showing beneath the outer wear, especially at the neck, arms and lower edge. Slips usually do not cling tightly to the body and create bulk under outer clothing. If the slip is made of clinging type fabric then the skirt of the outer garment will not hang as smoothly as it would over a slick material.

Prior inventions have not been made of the proper fabric or design to properly stay close to the body, nor have they been cut and joined to diminish the noticeability of the garment beneath outer clothing.

The fabric of the camisole must be thin, light weight, stretchable and absorbent. There are many fabrics available today that could be used, with thin cotton yarn machine knit into a stretchable fabric being preferred.

Referring to the Figures, the camisole body 3 is cut and joined to create a close fit. In this embodiment the garment is formed from six panels although other methods, such as four panel construction, could also be employed to achieve the same goal. The neck line 5 is cut low and can be trimmed with a stretchable material that stabilizes the fabric edges and holds the neck edge close to the wearer's body. In the preferred embodiment the trim is a stretch lace. The sleeve seam 7 joins the sleeve to the body at the arm hole. At this seam the fabric at the joining edge of the sleeve is slightly longer than the fabric at the joining edge of the body, creating a slight fullness on the sleeve side of the seam. This allows a smoother drape and more comfortable fit.

The sleeve is cut and joined to the body to form what the inventor calls a "V-cut" that creates a sleeve edge 9 that is positioned diagonally from the armpit to the lower shoulder. Rather than being positioned horizontally from the arm pit to the outer arm directly across from the arm pit, the V-cut follows the natural folds of the arm which makes the edge unnoticeable under the outer garment. The body of the camisole extends down not longer that the top of the wearer's thighs to the hem of the camisole 11. Again the fabric at the hem is trimmed, perhaps with stretch lace, to slightly gather the edge to hold it close to wearers body. In the full slip embodiment the lower edge of the camisole 11 is joined to a skirt 13 that is made of a fabric that has little nap and superior slipping properties, such as nylon knit.

What is claimed is:

1. An undergarment comprising a fabric that is capable of wicking moisture from a wearer's body without transferring said moisture to an outer garment, said fabric formed into said undergarment by being cut into sections herein referred to as sleeve, front, and back and said fabric distinguished by having bulk and edges;

said sections joined in such a way that said bulk and said edges of said fabric are not easily detectable under sheer outerwear;

wherein said front and said back join at seams referred to as shoulder seams and side seams to form a body having a neck hole and two arm holes;

said body having joining edges at said arm holes and said sleeves having joining edges and outer edges wherein said sleeve joining edges joins said body joining edges at a seam referred to as a sleeve seam, said sleeve seam having a body side and a sleeve side;

wherein said fabric at said joining edge of said sleeve is slightly longer than said fabric at said joining edge of said body, creating a slight fullness on said sleeve side of said sleeve seam, wherein said fabric at said outer edge of said sleeve is gathered to hold said outer edge close to said wearer's body, wherein said sleeve is cut in a manner that, when joined to said body, forms a "V" shape of said seam and said outer edge when viewed from the back or front of said body.

2. The undergarment of claim 1 wherein said body fits the form of said wearer in a manner as not to be detected through said outerwear, with said fabric of said body extending down not longer that the top of said wearer's thighs forming a lower edge, with said fabric at said lower edge gathered at said thighs to hold said lower edge close to said wearer's body.

3. The undergarment of claim 1 wherein said body fits the form of wearer in a manner as not to be detected through said outerwear, with said fabric of said body extending down not longer that the top of said wearer's thighs forming a lower edge, with said lower edge joined with a skirt portion, said skirt portion made of a fabric having slipping properties.

* * * * *